United States Patent [19]

Merz et al.

[11] Patent Number: 5,032,469

[45] Date of Patent: Jul. 16, 1991

[54] METAL ALLOY COATINGS AND METHODS FOR APPLYING

[75] Inventors: Martin D. Merz, Richland; Robert W. Knoll, Kennewick, both of Wash.

[73] Assignee: Battelle Memorial Institute, Richland, Wash.

[21] Appl. No.: 532,751

[22] Filed: Dec. 20, 1989

Related U.S. Application Data

[63] Continuation-in-part of Ser. No. 241,080, Sep. 6, 1988, abandoned.

[51] Int. Cl.[5] ..... B05D 1/08; B05D 1/02

[52] U.S. Cl. ..... 428/662; 427/34; 427/423; 428/660; 428/661; 428/685

[58] Field of Search ..... 427/34, 423; 75/10.19; 428/660, 661, 662, 685

[56] References Cited

U.S. PATENT DOCUMENTS

| | | | |
|---|---|---|---|
| 3,892,601 | 7/1975 | Smeggil et al. | 148/31.57 |
| 3,904,383 | 9/1975 | Murphy et al. | 29/196.1 |
| 4,172,718 | 10/1979 | Menzel | 75/174 |
| 4,303,693 | 12/1981 | Driver | 427/34 |
| 4,496,635 | 1/1985 | Wang et al. | 428/680 |
| 4,503,085 | 3/1985 | Dickson et al. | 427/34 |
| 4,508,788 | 4/1985 | Cheney | 428/570 |
| 4,529,616 | 7/1985 | Smythe | 427/34 |
| 4,615,732 | 10/1986 | Shastry et al. | 148/403 |
| 4,626,476 | 12/1986 | Londry et al. | 428/457 |
| 4,687,678 | 8/1987 | Lindblom | 427/34 |
| 4,723,589 | 2/1988 | Iyer et al. | 164/46 |
| 4,731,253 | 3/1988 | DuBois | 427/34 |

FOREIGN PATENT DOCUMENTS

| | | |
|---|---|---|
| 55-77599 | 6/1980 | Japan . |
| 60-46395 | 3/1985 | Japan . |

OTHER PUBLICATIONS

R. Wang et al., "Anti-Corrosion Glassy Alloy Coating on Heat-Affected Zone of Welds", Jan. 1985.

E. Lugscheider et al., "Vacuum Plasma Spraying of Tantalum and Niobium", J. Vac. Sci. Technol. A 3(6) Nov./Dec. 1985, pp. 2469-2473.

H. D. Steffens et al., "A Comparison of Low-Pressure Arc and Low-Pressure Plasma Sprayed Titanium Coatings", J. Vac. Sci. Technol. Nov./Dec. 1985, pp. 2459-2463.

Miura et al., "Production of Amorphous Be-Ni Based Alloys by Flame-Spray Quenching", Transactions of the Japan Institute of Metals, vol. 22, No. 9 (1981, pp. 597-606.

Gagne et al., "The Fabrication and Characterization of Metalic Glass Coating", *High Temperature Technology*, Nov. 1982, pp. 93-99.

Knotek et al., "On Plasma Sprayed $WSi_2$ and $Cr_3C_2$-Ni Coatings" J. Vac. Sci. Technol. A3(6), Nov./Dec. 1985, pp. 2490-2493.

Naoe et al., "Nickel Ferrite Thick Films Deposited by Vacuum-Arc Discharge", *Japanese Journal of Applied Physics*, vol. 9, No. 3, Mar. 1970, pp. 293-301.

Miura et al., "Production of Amorphous Iron-Nickel Based Alloys by Flame-Spray Quenching and Coating of Metal Substrats", Transactions of the Japan Institute of Metals, vol. 25, No. 4 (1984), pp. 284-291.

Giessen et al., "Sheet Production of an Amorphous Zr-Cu Alloy by Plasma Spray Quenching", Metallurgical Transactions A, 364-vol. 8A, Feb. 1977, pp. 364-366.

Panchanathan et al., "Nickel Base Metallic Glass Powder for Application as Plasma Sprayed Coatings", Institute of Chemical Analysis, Northeastern University, Boston, MA.

Boxman et al., "Fast Deposition of Metallurgical Coatings and Production of Surface Alloys Using a Pulsed High Current Vacuum Arc", *Thin Solid Films*, 139, (1986), pp. 41-52.

Vinayo et al., "Plasma Sprayed WC-Co Coatings: Influence of Spray Conditions (Atmospheric and Low Pressure Plasma Spraying) on the Crystal Structure, Porosity, and Hardness" J. Vac. Sci. Technol. Nov./-Dec. 1985, pp. 24832489.

*Primary Examiner*—Shrive Beck

*Attorney, Agent, or Firm*—Wells, St. John & Roberts

[57] ABSTRACT

A method of coating a substrate comprises plasma spraying a prealloyed feed powder onto a substrate, where the prealloyed feed powder comprises a significant amount of an alloy of stainless steel and at least one refractory element selected from the group consisting of titanium, zirconium, hafnium, niobium, tantalum, molybdenum, and tungsten. The plasma spraying of such a feed powder is conducted in an oxygen containing atmosphere and forms an adherent, corrosion resistant, and substantially homogenous metallic refractory alloy coating on the substrate.

29 Claims, No Drawings

METAL ALLOY COATINGS AND METHODS FOR APPLYING

This is a continuation-in-part of application Ser. No. 241,080, filed Sept. 6, 1988 now abandoned.

TECHNICAL FIELD

This invention relates to protective metal alloy coatings, and methods of applying or forming such coatings on substrates.

BACKGROUND OF THE INVENTION

Highly corrosive environments require the use of materials which are able to withstand corrosive attack from the particular environment for extended periods of time. For example, blades and other components in turbines used to generate electrical power from steam recovered from geothermal sources must be able to function in an environment containing high concentrations of sulfur dioxide, chloride ions and other highly corrosive materials.

Further, chemical reaction vessels, pipes leading to them, and similar apparatus are sometimes exposed to highly corrosive acid solutions, such as concentrated nitric acid. Stainless steels are commonly used for the construction of such equipment, but even they do not have sufficient corrosion resistance under certain circumstances.

Corrosion-resistant coatings of amorphous alloys of stainless steel are presently available for the protection of substrates which are subject to corrosive attack by their environment. Most of these alloys are stabilized in the amorphous state by one or more of the metalloid elements such as B, C, Si and P. Our patent applications Ser. Nos. 360,117 and 060,759, now U.S. Pat. Nos. 4,496,635 and 4,786,468, respectively, describe enhanced amorphous coatings for rendering a substrate highly corrosion resistant. These two patents are hereby incorporated by reference.

The coating described in the U.S. Pat. No. 4,496,635 is capable of remaining amorphous at temperatures up to 400° C. It consists essentially of the formula $M_aCr_bT_c$, where "M" is at least one element selected from the group consisting of iron and nickel, "T" is at least one element selected from the group consisting of tantalum, titanium, zirconium, hafnium, niobium, molybdenum, and tungsten. Quantity "a" is 35–75 mole percent, "b" is 5–20 mole percent, "c" is 5–55 mole percent, and "b" plus "c" is equal to at least 25 mole percent.

U.S. Pat. No. 4,786,468 describes a coating consisting essentially of an alloy of stainless steel and at least one of tantalum or tungsten present in a range of from 60–90 mole %.

Examples in these patents describe depositing of such glassy stainless steel coatings by sputter deposition in small scale experiments (less than or equal to 0.1 $m^2$ area substrates). Sputter deposition requires a high vacuum environment and typically achieves a low deposition rate. It may be prohibitively expensive to sputter deposit onto large surfaces or to a large number of parts where coating thicknesses need to be between 25–250 microns.

Plasma spraying of alloy coatings is also recognized as an application method in the prior art. Such processes when applied to materials that readily oxidize such as refractory metal alloys, generally require plasma spraying in a low pressure atmosphere (vacuum) or in the presence of an inert gas. For example, studies of plasma sprayed Ta, Nb, Ti, and WC stress the need for an inert gas atmosphere or vacuum to obtain dense, high purity coatings. See for example, E. Lugscheider et al., "Vacuum Plasma Spraying of Tantalum and Niobium", *J. Vac. Sci. Tech.* A3 (1985) 2469–2473; H. D. Steffens et al.; "A Comparison of Low Pressure Arc and Low Pressure Plasma Sprayed Titanium Coatings", *J. Vac. Sci. Tech.* A3 (1985) 2459–2463; and M. E. Vinayo et al., "Plasma Sprayed Sc-Co Coatings: Influence of Spray Conditions (Atmospheric and Low Pressure Plasma Spraying) on the Crystal Structure, Porosity, and Hardness", *J. Vac. Sci. Tech.* A3 (1985) 2483–2489. Apparently good $WSi_2$ coatings have been produced in an open oxygen containing atmosphere, but the coatings were not significantly amorphous. See for example, O. Knotek et al., "On Plasma Sprayed $WSi_2$ and $Cr_3C_2$-Ni Coatings", *J. Vac. Sci. Tech.* A3 (1985) 2490–2493.

Using an inert gas or a vacuum atmosphere for plasma spraying adds to inconvenience and cost for refractory metal alloy coating process. This invention overcomes these and other problems associated with plasma spraying of coatings onto substrates.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

In accordance with the invention, a method of coating a substrate comprises plasma spraying of particular prealloyed feed powders onto a substrate in an oxygen containing atmosphere. Such method enables the creation of an adherent, corrosion resistant, substantially amorphous and substantially homogenous metallic refractory alloy coating on the substrate in spite of such spraying in the presence of oxygen. For purposes of this document, the term "substantially amorphous" identifies a substance having a microcrystalline domain size of less than or equal to about 2.5 nanometers. The particular prealloyed feed powders comprise a significant amount of an alloy of stainless steel and at least one refractory element selected from the group consisting of titanium, zirconium, hafnium, niobium, tantalum molybdenum, and tungsten. The particular prealloyed feed powders do not require the inclusion of boron to induce or maintain an amorphous state, unlike those coating compositions of U.S. Pat. No. 4,503,085 to Dickson et al. Boron is well known as a product that induces the amorphous state, but yet negatively impacts the properties of the finished coatings. See for example U.S. Pat. No. 4,172,718 to Menzel, at col. 1, lns. 56–63 where boron is indicated as being an amorphous inducing stabilizer, but adversely impacts the properties of the finished coatings. The Dickson et al. coatings require a boron content of between four and fifteen percent (col. 2, ln. 20) which adversely affects the properties of a finished coating. In accordance with the invention, an amorphous state is induced in the finished coating by the refractory which enables amorphous compositions having less than four percent boron, and most preferably no boron.

It has been discovered that by controlling the preparation of such prealloyed feed powders, plasma spraying in air is capable of producing such adherent, corrosion resistant, substantially amorphous and substantially homogenous metallic refractory alloy coatings on substrates. The prealloying is preferably sufficient to achieve intimate mixing of the alloy elements on an atomic scale to produce intermetallic chemical bonding of the stainless steel elements with the refractory metal or metals. The intent is to produce a prealloyed powder wherein most all of the particles of the particular batch comprise the same alloy or compound. What is required is that the feed powder contain a significant amount of the prealloyed material to achieve a coating which is sufficiently amorphous to have an appreciable advantageous effect on corrosion resistance.

Sufficient prealloying of the refractory and constituent elements of the stainless within the feed powder was determined to be necessary to produce the desired adherent protective coatings. This will be apparent from the continuing discussion wherein a coating formed from spraying an insignificantly prealloyed powder is compared with the spraying of a feed powder consisting essentially of a substantially prealloyed mixture.

The refractory element is preferably present in the prealloyed powder in a concentration from 30–85 mole percent. An amount of 15–20 mole percent is believed to be the minimum acceptable amount. The stainless steel is preferably present in a concentration of from 70–15 mole percent. It is anticipated that any of the stainless steels, such as the 300 and 400 stainless steel series, can be used to produce the desired prealloyed feed powder. Preferably, the thermal expansion/contraction properties of the applied coating will be designed to fairly well match those of the particular substrate. The thicker the applied coating, the greater the desirability of closely matching the respective expansion/contraction properties.

The alloyed feed powders of the invention are preferably prepared by arc-melting and with significant mechanical grinding which produces a feed powder for plasma spraying which is not itself amorphous in the powder phase. However, the refractory content and subsequent plasma spraying will produce a finished amorphous coating. Prior art coatings such as Dickson et al.'s hinge on boron content and powder preparation techniques (rapid cooling to produce a thin ribbon on a moving chill surface, subsequently ground to provide an amorphous powder for spraying) which produces amorphous powders. The prealloyed feed powders of this invention preferably include no boron, but in any event would produce an amorphous powder even were boron included up to the minimum four percent which Dickson et al. disclose is required. In other words, Applicant obtains an amorphous coating where the boron content is something less than four percent boron.

Any suitable substrate to which the coating will adhere can be used. Preferably the substrate will have a metallic or metallized surface to which the coating is applied and bonded. Examples of suitable substrate materials are copper and steel. Specific example steels include stainless steels selected from the group consisting of low carbon stainless steels, high carbon stainless steels, low alloy stainless steels, high alloy stainless steels including 400 Series and tool steels, and 300 Series stainless steels, or mixtures thereof. The substrate surface is preferably treated by bead or grit blasting to roughen the bonding surface and achieve a strongly adhered coating. An intermediate metallic bonding layer such as nichrome could also be applied to the substrate, with the prealloyed feed powder being subsequently sprayed onto the intermediate layer.

The thickness of the applied coating will depend upon the geometry of the substrate and the environment in which the material will operate, as will readily be appreciated by the artisan.

EXAMPLES

A small quantity (0.5 kg) of a substantially prealloyed Ta-stainless steel powder was produced for plasma spraying. The prealloyed feed powder starting material consisted of five stacks, each weighing approximately 105 grams, of alternating tantalum and 304 stainless steel sheets. Each stack was 3.8 cm×1.9 cm×1.5 cm in size and contained approximately 76 weight percent tantalum and 24 weight percent stainless steel. (approximately 50 mole percent tantalum and 50 mole percent stainless steel.) The materials in the stack were alloyed by arc melting each stack on a water-cooled copper hearth in an argon atmosphere. The resulting ingots were remelted several times, and then turned over and remelted at least once.

The alloyed ingot material was very brittle and could be easily fractured by impact. Each ingot was reduced to a powder in a Pitchford Pica Model 3800 blendermill. The produced powders were repeatedly sieved and reground until all powder to be used for plasma spraying passed through a No. 170 mesh (90 micron) screen. X-ray diffraction analysis of the powder revealed an intimate mixture of NiTa and FeTa intermetallic compounds. Scanning electron micrographs showed the particles to be single phase indicating that the intermetallic phases were intimately mixed.

Substrates coated in air with the above prealloyed feed powder (as described below) were compared with substrates coated in air with a feed powder that had an insignificant amount of pre-alloying. Such control powder consisted of −150/+325 mesh material comprised of approximately 50 mole percent Ta and 50 mole percent 304 stainless steel (approximately 77 weight percent Ta-23 weight percent stainless steel). Scanning electron microscope analysis of such powder indicated that less than 10 weight percent of the material was alloyed. Scanning electron micrographs revealed that each particle was primarily a conglomerate of tantalum and stainless steel particles. X-ray diffractions also showed that the particles consisted mainly of stainless steel and elemental Ta, as opposed to an intermetallic alloy.

Coatings of such powders were plasma sprayed onto copper and mild carbon steel (ASTM-A569) plates 0.32 cm thick by 12.7 cm or 15.2 cm diameter. In some experiments, the backside of the substrate was directly water-cooled to maintain the substrate near ambient room temperature during the spraying process. Those substrates were fastened to an O-ring-sealed reservoir having circulating 15° C. water. Various surface preparation methods were used to test the effect of surface quality on coating adhesion. The initial substrate surface was that of as-rolled plate metal, and this surface was either bead blasted or grit blasted. In some cases, a plasma sprayed nichrome was first applied to the substrate before the tantalum-stainless steel coating.

Table 1 below identifies the various substrate surface preparation methods, labelled A, B, C, and D, that were employed.

TABLE 1

| Substrate Surface Preparation Methods |
|---|
| A. Bead-blast with glass microspheres, wash with high pressure |

TABLE 1-continued

| Substrate Surface Preparation Methods |
|---|
| water spray, air dry, and rinse with acetone spray. |
| B. Grit-blast with SiC particles, rinse with acetone spray. |
| C. Bead-blast as above, then coat with 0.1 mm plasma sprayed nichrome. |
| D. Grit-blast as above, then coat with 0.1 mm plasma-sprayed nichrome. |

Plasma spraying was performed with a Plasmadyne, Inc. hand-held spray gun under ambient conditions in open air. The spray parameters are listed in Table 2 below.

TABLE 2

| Plasma Spray Parameters |
|---|
| Gun Current: 500 Amps |
| Gun voltage: 30–35 VDC |
| Main Gas (Ar) flow rate: 50 cubic ft./hour (393 $cm^3$/sec) |
| Powder gas (Ar) flow rate: 12 cubic ft./hour (94 $cm^3$/sec) |
| Powder feed gear setting: 30; gear A |
| Gun-to-substrate distance: approximately 3 inches (7.6 cm) |

The substrates were positioned face-up on a horizontal surface with a coating applied by manually sweeping the plasma gun across the surface at a rate of approximately 5 cm/sec. The plasma jet was oriented normal to the substrate surface with an approximately gun-to-surface distance of 7 to 7.6 cm. A single pass was sufficient to deposit a layer of 50–75 microns (0.002–0.003 inches) thick. A coating 150–200 microns (0.006–0.009 inches) thick on a 15 cm diameter substrate could be made with three passes in less than two minutes. After three passes, the uncooled substrates reached an average estimated maximum surface temperature of 300° C. The water-cooled substrates reached approximately 50° C.

The coatings were analyzed to determine the crystalline phases present, surface topography and microstructure, chemical homogeneity, corrosion resistance, and adherence to the particular substrate. Crystallinity was measured by X-ray diffraction using Cu K alpha X-rays and a diffractometer, over the two-theta range of 10° to 80°. Surface structure and homogeneity were examined with a scanning electron microscope equipped with energy dispersive X-ray spectroscopy for elemental analysis.

Corrosion rates were determined by soaking the coating in hot 8 molar $HNO_3$ or 8 molar $H_2SO_4$ at 100° C. for seven days. Corrosion rates were determined by measuring the weight loss after such soaking. Specimens were weighed before and after the hot acid soak and calculated using the following formula:

$$V=(W\times 24\times 365\times 10)/(S\times G\times H)$$

where:

V=corrosion rate, mm/yr.

W=corrosion weight loss, g.

S=surface area of test specimen, $cm^2$

G=density of coating material, g./$cm^3$

H=test time (168 hours)

Coating adherence was measured using a Sebastian Model I Adherence Tester. For each measurement, an aluminum stud was epoxied to the coating surface, with the instrument applying tension to the stud until fracture occurred.

Table 3 below lists the various powder types and the substrates used for the coatings. Specimens SS-W-1 and SS-W-2 were made from heterogeneous (unalloyed) mixtures of tungsten and stainless steel powders. X-ray diffraction of coatings produced from these specimens showed that the coatings consisted of stainless steel and elemental tungsten particles with no significant alloying. All of the powders used for spraying were not amorphous in powder form, but those with a sufficient degree of prealloying were induced

TABLE 3

Summary of Plasma Sprayed Coatings and Substrates

| Substrate ID No. | Powder Type | Substrate Type/Surface Preparation Method (See Table 1) |
|---|---|---|
| SS-W-1 | Powder mixture, 70 wt. % W powder and 30 wt. % 18-8 stainless steel (SS) powder | water cooled copper/A |
| SS-W-2 | Powder mixture, 70 wt. % W powder and 30 wt. % 18-8 stainless steel (SS) powder | water cooled copper/A |
| Ta-SS-1 | Approximately 10% prealloyed mixture, 77 wt. % Ta and 23 wt. % 304 SS | cooled and uncooled copper/A |
| Ta-SS-2 | Approximately 10% prealloyed mixture, 77 wt. % Ta and 23 wt. % 304 SS | water cooled steel/A, B, C, D |
| Ta-SS-3 | Approximately 10% prealloyed mixture, 77 wt. % Ta and 23 wt. % 304 SS | uncooled copper/A, B, C, D |
| Ta-SS-4 | Approximately 10% prealloyed mixture, 77 wt. % Ta and 23 wt. % 304 SS | uncooled steel/A, B, C, D |
| Ta-SS-5 | Substantially prealloyed, 76 wt. % Ta and 24 wt. % SS | water cooled steel/B |
| Ta-SS-6 | Substantially prealloyed, 76 wt. % Ta and 24 wt. % SS | uncooled steel/B |
| Ta-SS-7 | Substantially prealloyed, 76 wt. % Ta and 24 wt. % SS | uncooled copper/B |

Table 4 below is a side-by-side comparison of two of the substrates of Table 3, one being coated with a substantially prealloyed feed powder and the other being coated with the only 10% prealloyed feed powder.

TABLE 4

| Analysis | Comparison of an Only 10% Prealloyed Feed Powder with a Substantially Prealloyed Feed Powder | |
|---|---|---|
| | TA-SS-7--Substantially Prealloyed | TA-SS-3--Primarily (Only 10% Prealloyed) Nonalloyed and Multiphase |
| Composition | 76 wt. % Ta and 24 wt. % SS | 77 wt. % Ta and 23 wt. % SS |
| Crystalline/ Amorphous nature | Microcrystalline or nearly amorphous metal, with minor amount of crystalline Ta oxide | Crystalline mixture of Ta, 304 SS, Ta—Fe and Ta—Ni intermetallic compounds, and a minor amount of oxides |
| Adherence to uncooled substrate | 2000 psi | 4500 psi |
| Corrosion during 7 days in 100° C. 8 M $HNO_3$: % wt. loss | 0.046% | 24.4% |
| Corrosion Rate | 0.0018 mm/yr | 1.2 mm/yr |
| Corrosion during 7 days in 100° C. 8 M $H_2SO_4$: % wt. loss | 0.22% | |
| Corrosion Rate | 0.007 mm/yr | not measured |

Analysis of coatings made from the substantially prealloyed feed powder appeared compositionally uniform. X-ray diffraction patterns of coatings deposited on water-cooled steel and on uncooled copper were nearly identical. The crystalline domain size was determined to be about 1.8 nanometers. The minor amount of crystalline tantalum oxide, which apparently formed during spraying, was homogeneously distributed and apparently does not have appreciable negative effects on the formed coating. Analysis of various surface regions using energy dispersive X-ray spectroscopy and back scattered electron imaging with a scanning electron microscope did not detect any compositional nonuniformities.

The compositional heterogeneity of the only 10% prealloyed feed powder carried through to the coating and produced a multiphase coating. Back scattered electron imaging from a scanning electron microscope showed significant contrast between 70–100 micron distant neighboring regions. Energy dispersive X-ray spectroscopy analysis verified the compositional difference between these regions. The tantalum content of various surface features ranged from 9 mole percent to more than 80 mole percent.

The results indicated that glassy refractory-stainless steel alloy coatings can be produced by plasma spraying under ambient conditions with no provision for substrate cooling. Poor corrosion resistant coatings are formed where the refractory and stainless steel elements in the feed powder are not significantly prealloyed, which results in a multiphase microstructure. It is postulated that greater than 50% of the alloy components in the feed powder must be prealloyed to produce a coating applied in air that is significantly amorphous to have an appreciable effect on corrosion resistance.

In compliance with the statute, the invention has been described in language more or less specific as to methodical and compositional features. It is to be understood, however, that the invention is not limited to the specific features described, since the means herein disclosed comprise preferred forms of putting the invention into effect. The invention is, therefore, claimed in any of its forms or modifications within the proper scope of the appended claims, appropriately interpreted in accordance with the doctrine of equivalents.

We claim:

1. A method of coating a substrate comprising:

plasma spraying a prealloyed feed powder onto a substrate, the prealloyed feed powder comprising an alloy of stainless steel and at least one refractory element selected from the group consisting of titanium, zirconium, hafnium, niobium, tantalum, molybdenum, and tungsten, the prealloyed feed powder containing no boron or at most an amount of boron which is ineffective to render the coating amorphous because of the presence of boron, the prealloyed feed powder in the powder state being non-amorphous, the plasma spraying of such a feed powder being conducted in an atmosphere containing a considerable amount of oxygen, and forming an adherent, corrosion resistant, substantially amorphous and substantially homogenous metallic refractory alloy coating on the substrate, the refractory element present in the prealloyed feed powder being the agent that renders the coating substantially amorphous.

2. The method of claim 1 further comprising plasma spraying the prealloyed feed powder onto a substrate in air under ambient atmospheric temperature and pressure conditions.

3. The method of claim 1 wherein the refractory element is present in the prealloyed powder in a concentration from 30 to 85 mole percent and the stainless steel is present in a concentration from 70 to 15 mole percent.

4. The method of claim 1 wherein the refractory element comprises tantalum.

5. The method of claim 1 wherein the stainless steel is of the 300 series.

6. The method of claim 1 wherein the stainless steel is of the 400 series.

7. The method of claim 1 wherein the prealloyed feed powder consists essentially of the alloy into the amorphous state upon spraying by the inclusion of the refractory.

8. The method of claim 7 wherein the refractory element is present in the prealloyed feed powder in a concentration from 30 to 85 mole percent and the stainless steel is present in a complementary concentration from 70 to 15 mole percent.

9. The method of claim 8 wherein the refractory element comprises tantalum.

10. The method of claim 1 wherein the substrate is a steel.

11. The method of claim 10 wherein the steel is a stainless steel selected from the group consisting of low carbon stainless steels, high carbon stainless steels, low alloy stainless steels, high alloy stainless steels including 400 Series and tool steels, and 300 Series stainless steels, or mixtures thereof.

12. The method of claim 1 wherein the substrate comprises a metallic or metallized surface to which the coating is applied.

13. A substrate coated by the method of claim 1.

14. The substrate of claim 13 wherein the substrate comprises a stainless steel selected from the group consisting of low carbon stainless steels, high carbon stainless steels, low alloy stainless steels, high alloy stainless steels including 400 Series and tool steels, and 300 Series stainless steels, or mixtures thereof.

15. The method of claim 1 further comprising: applying an intermediate metallic layer to the substrate; and plasma spraying the prealloyed feed powder onto the intermediate metallic layer.

16. The method of claim 1 wherein the formed coating is capable of remaining amorphous at temperatures up to at least 400° C., and consists essentially of the formula $M_aCr_bT_c$, where M is at least one element selected from the group consisting of iron and nickel, T is at least one element selected from the group consisting of tantalum, titanium, zirconium, hafnium, niobium, molybdenum, and tungsten and where "a" is 35 to 75 mole percent, "b" is 5 to 20 mole percent, "c" is 5 to 55 mole percent and "b" plus "c" is equal to at least 25 mole percent.

17. The method of claim 1 wherein, the formed coating consists essentially of an alloy of stainless steel and one or both of tantalum and tungsten, the tantalum or tungsten being present in a range of from 60 to 90 mole percent.

18. The method of claim 1 wherein, the prealloyed feed powder consists essentially of the alloy; and the substrate comprises a metallic or metallized surface to which the coating is applied.

19. The method of claim 18 wherein the refractory element is present in the prealloyed powder in a concentration from 30 to 85 mole percent and the stainless steel is present in a complementary concentration from 70 to 15 mole percent.

20. A method of coating a substrate comprising:

prealloying ingredients of a mixture consisting essentially of (a) a stainless steel, and (b) at least one refractory element selected from the group consisting of titanium, zirconium, hafnium, niobium, tantalum, molybdenum, and tungsten, to produce a solidified prealloyed mixture, the mixture containing no boron or at most an amount of boron which is ineffective to render the coating amorphous because of the presence of boron;

grinding the solidified prealloyed mixture to produce a prealloyed feed powder that is non-amorphous; and plasma spraying the prealloyed feed powder onto a substrate in an atmosphere containing a considerable amount of oxygen, and thereby forming an adherent, corrosion resistant, substantially amorphous and substantially homogeneous metallic refractory alloy coating on the substrate, the refractory element present in the prealloyed feed powder being the agent that renders the coating substantially amorphous.

21. The method of claim 20 further comprising plasma spraying the prealloyed feed powder onto a substrate in air under ambient atmospheric temperature and pressure conditions.

22. The method of claim 20 wherein the refractory element is present in the prealloyed powder in a concentration from 30 to 85 mole percent and the stainless steel is present in a complementary concentration from 70 to 15 mole percent.

23. The method of claim 20 wherein the prealloyed feed powder consists essentially of the alloy.

24. A substrate coated by the method of claim 20.

25. The substrate of claim 24 wherein the substrate comprises a stainless steel selected from the group consisting of low carbon stainless steels, high carbon stainless steels, low alloy stainless steels, high alloy stainless steels including 400 Series and tool steels, and 300 Series stainless steels, or mixtures thereof.

26. The method of claim 20 wherein the formed coating is capable of remaining amorphous at temperatures up to at least 400° C., and consists essentially of the formula $M_aCr_bT_c$, where M is at least one element selected from the group consisting of iron and nickel, T is at least one element selected from the group consisting of tantalum, titanium, zirconium, hafnium, niobium, molybdenum, and tungsten and where "a" is 35 to 75 mole percent, "b" is 5 to 20 mole percent, "c" is 5 to 55 mole percent, and "b" plus "c" is equal to at least 25 mole percent.

27. The method of claim 20 wherein, the formed coating consists essentially of an alloy of stainless steel and at least one of tantalum or tungsten, the tantalum or tungsten being present in a range of from 60 to 90 mole percent.

28. The method of claim 20 wherein the substrate is a steel.

29. The method of claim 28 wherein the steel is a stainless steel selected from the group consisting of low carbon stainless steels, high carbon stainless steels, low alloy stainless steels, high alloy stainless steels including 400 Series and tool steels, and 300 Series stainless steels, or mixtures thereof.

* * * * *